US009237398B1

(12) United States Patent
Algazi et al.

(10) Patent No.: US 9,237,398 B1
(45) Date of Patent: Jan. 12, 2016

(54) MOTION TRACKED BINAURAL SOUND CONVERSION OF LEGACY RECORDINGS

(71) Applicant: Dysonics Corporation, Davis, CA (US)

(72) Inventors: V. Ralph Algazi, Davis, CA (US); Richard O. Duda, Menlo Park, CA (US)

(73) Assignee: DYSONICS CORPORATION, Davis, CA (US)

( * ) Notice: Subject to any disclaimer, the term of this patent is extended or adjusted under 35 U.S.C. 154(b) by 70 days.

(21) Appl. No.: 14/103,766

(22) Filed: Dec. 11, 2013

Related U.S. Application Data

(60) Provisional application No. 61/735,906, filed on Dec. 11, 2012, provisional application No. 61/736,291, filed on Dec. 12, 2012.

(51) Int. Cl.
*H04R 1/10* (2006.01)
*H04R 1/32* (2006.01)

(52) U.S. Cl.
CPC ..... *H04R 1/323* (2013.01)

(58) Field of Classification Search
CPC ..... H04S 1/005; H04S 2420/01
USPC ..... 381/310
See application file for complete search history.

(56) References Cited

U.S. PATENT DOCUMENTS 7,333,622 B2 2/2008 Algazi et al.
2008/0056517 A1 * 3/2008 Algazi ..... H04S 7/304 381/310

* cited by examiner

*Primary Examiner* — Simon King
(74) *Attorney, Agent, or Firm* — John P. O'Banion

(57) ABSTRACT

Systems and methods are disclosed for a sound reproduction apparatus configured for receiving signals representative of the output of a plurality of microphones positioned to sample a sound field at points representing possible locations of a listener's left and right ears when positioned in said sound field at the location of the microphones, receiving a location of at least one sound source relative to said plurality of microphones, receiving orientation data of the listener's head, and calculating a binaural output using the sound source location, microphone output signals and orientation data. The binaural output includes the full-bandwidth of the microphone output signals.

27 Claims, 4 Drawing Sheets

MOTION TRACKED BINAURAL SOUND CONVERSION OF LEGACY RECORDINGS

CROSS-REFERENCE TO RELATED APPLICATIONS

This application is a nonprovisional of U.S. provisional patent application Ser. No. 61/735,906 filed on Dec. 11, 2012, incorporated herein by reference in its entirety, and a nonprovisional of U.S. provisional patent application Ser. No. 61/736,291 filed on Dec. 12, 2012, incorporated herein by reference in its entirety.

STATEMENT REGARDING FEDERALLY SPONSORED RESEARCH OR DEVELOPMENT

Not Applicable

INCORPORATION-BY-REFERENCE OF COMPUTER PROGRAM APPENDIX

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to processing of audio signals, and more particularly to the processing and rendering over headphones of audio signals that change dynamically in response to head rotation.

2. Description of Related Art

U.S. Pat. No. 7,333,622 which is incorporated herein by reference in its entirety, describes a novel and effective method, denoted Motion Tracked Binaural (MTB), to capture and render over headphones the dynamic changes of binaural sound caused by the rotation of the listener's head. MTB uses a small number of microphones positioned on a head-sized spherical or cylindrical surface to achieve this goal. The basic problem that MTB solves is the interpolation of the signals obtained from adjacent microphones without requiring an impractical number of microphones. The MTB method exploits two important properties of human hearing:

(a) The interaural time difference or ITD is the dominant localization cue; and (b) The auditory system is insensitive to ITD above about 1.5 kHz.

The spacing of microphones is determined by the highest frequency of the signals to be captured. The MTB method increases the spacing and thus reduces the number of microphones by first low-pass filtering the signals to remove spectral content above 1.5 kHz before interpolation. However, the high-frequency content is needed for good sound quality and must be restored. The MTB patent suggests several approximate ways to restore the high-frequency content. These methods proposed are completely general and apply to the capture and rendering of any soundfield. They do not depend on the knowledge of the number or locations of the sound sources. However, each specific method that combines low-pass filtering and high-frequency content restoration is an approximation, and each has its own audible artifacts.

Accordingly, an object of the present invention is continuous interpolation with no separation of low and high frequencies, i.e., to enable wide-band or full-bandwidth interpolation.

BRIEF SUMMARY OF THE INVENTION

In reproducing legacy recordings, the number and locations of the loudspeaker(s) are known. The systems and methods of the present invention utilize this location information to enable continuous interpolation, with no separation of low and high frequencies, i.e., to enable wide-band or full-bandwidth interpolation. "Full bandwidth" is herein defined as the audible range from 16 Hz to 20,000 Hz. While the methods and systems of the present invention are particularly suited for processing the entire wide-band range, it is also appreciated that the systems and methods may be applied to portions of this range.

One aspect of the present invention is the processing and rendering over headphones of audio signals that change dynamically in response to head rotation. The systems and methods may best be demonstrated via the case of a single channel through a loudspeaker in a known position. The resulting dynamic sound approximates the sound that would be heard without headphones in the room where the sound was produced and recorded. The system and methods of the present invention apply to the conversion of legacy recordings such as stereo or 5.1 audio that are intended to be rendered over loudspeakers.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

A. Reproduction of a Single-Channel Signal

In performing wide-band interpolation of the signals from adjacent microphones, it is important to have an understanding of the true nature of the problem in order to exploit the knowledge of the location of the source relative to the microphone array.

The MTB interpolation problem is traditionally viewed as one of reconstructing a wave field from samples taken in space by the microphones. With this view, the Shannon/Nyquist sampling theorem is invoked by assuming that there must be at least two samples per wavelength for the shortest wavelength of interest. For wide-band interpolation, this criterion calls for a very short distance between microphones, and hence a large number of microphones.

However, this traditional solution to the MTB interpolation problem applies to the most general situation, in which there are multiple sources, and the incident waves can come from any direction. In that case, the signals picked up by the microphones comprise of a sum of many components, not only the direct sounds from the various sources but also all of the various reflections. As one moves around the sphere or cylinder, these many components gradually change both in amplitude and in time of arrival. Depending on their direction of incidence, some components will arrive sooner, and some will arrive later. For periodic signals, when these time shifts are less than half a period, simple linear interpolation will properly account for the intermediate time shift. However, when they are shifted by exactly half a period, phase cancellation causes the interpolated signal to disappear, and when they are shifted greater than half a period, the interpolated signal is meaningless. That is the source of the audible flanging artifacts.

However, for the situation in which there is only one source, and it is in an anechoic environment, there are no reflected components. In that case, there is only a single component, and as one moves around the sphere or cylinder to a first approximation, the primary change between two adjacent microphones is its time of arrival. If the signals at the two microphones could be time aligned before interpolation, and if an appropriate time delay could be restored after interpolation, the interpolation would be free of aliasing artifacts. A simple head model may be used to time align the signals before interpolation, and to restore the proper arrival time afterward.

Figure 1:
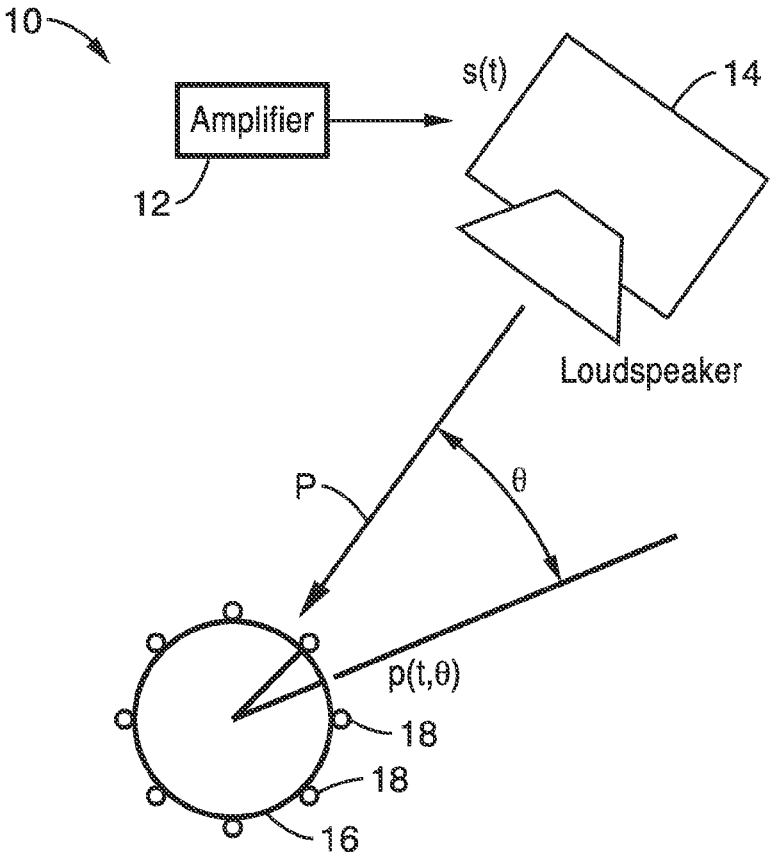
FIG. 1 shows a schematic diagram of a system producing a sound pressure that is developed on the surface of an MTB-style microphone array due to a signal s(t) used to drive a loudspeaker in a room.

FIG. 1 shows a schematic diagram of a system 10 having a pressure $p(t,\theta)$ that is developed on the surface of an MTB-style microphone array 16 at time t and azimuth $\theta$ due to a signal s(t) used to drive a loudspeaker 14 in a room. In the arrangement shown in FIG. 1, the signal s(t) from one channel of a multi-channel recording is reproduced by the loudspeaker 14 in a real room, and is captured by the individual microphones 18 of MTB-style microphone array 16. The pressure wave emitted by the loudspeaker 14 travels by multiple paths to the microphone array 16, with the direct path P that is incident on a point that is nearest the loudspeaker 14. In general, there is a propagation delay along this direct path P, but this fixed delay is accordingly ignored as a result of the choice of the time origin.

When considering a point on the microphone array surface at an azimuth angle $\theta$ relative to the direct path P, $p(t, \theta)$ denotes the sound pressure developed at that point at time t. In this example, it is assumed that the loudspeaker 14 is operating in its linear range. The system 10 is thus characterized by a transfer function, or, equivalently, by an impulse response $h(t, \theta)$, so that:

$$p(t,\theta)=\int_{-\infty}^{\infty}h(\tau,\theta)s(t-\tau)d\tau \qquad \text{Eq. 1}$$

The impulse response in Eq. 1 is quite complicated, since it accounts for several acoustic factors: 1) the response of the loudspeaker 14, 2) the multi-path reflections from surfaces in the room, and 3) the scattering of sound by the MTB-style microphone array 16. However, the impulse response completely characterizes the behavior of the system, and is measurable. In this embodiment, an amplifier 12 sends a signal to the loudspeaker 14.

Figure 2:
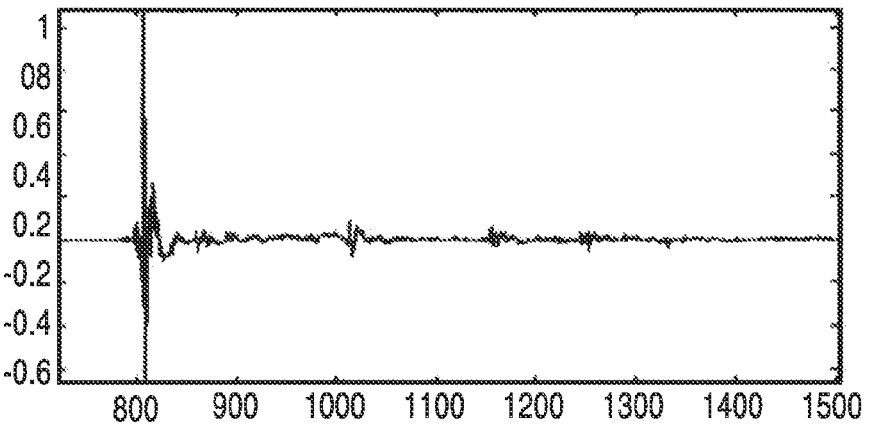
FIG. 2 shows a plot of the measured impulse response for the pressure p(t) developed on the surface of an MTB-style microphone array.

FIG. 2 shows a plot of the measured impulse response relating the pressure p(t) developed on the surface of an MTB-style microphone array 16 to the signal s(t) driving the loudspeaker 14 in a real room. Such measurements reveal the direct sound, the floor and ceiling reflections, other early reflections from walls, discrete multiple reflections and finally incoherent reverberation. From FIG. 2, the initial pulse, several early reflections, and the weak subsequent room reverberation, can be identified.

An objective of the system and method of the present invention is to interpolate the signals between two adjacent microphones 18, say, at $\theta_1$ and $\theta_2$. In general, this can be a difficult problem, but it is significantly simplified when taking in consideration the known location of the loudspeaker 14 relative to the MTB-style microphone array 16. We begin by examining the time of arrival.

Figure 3:
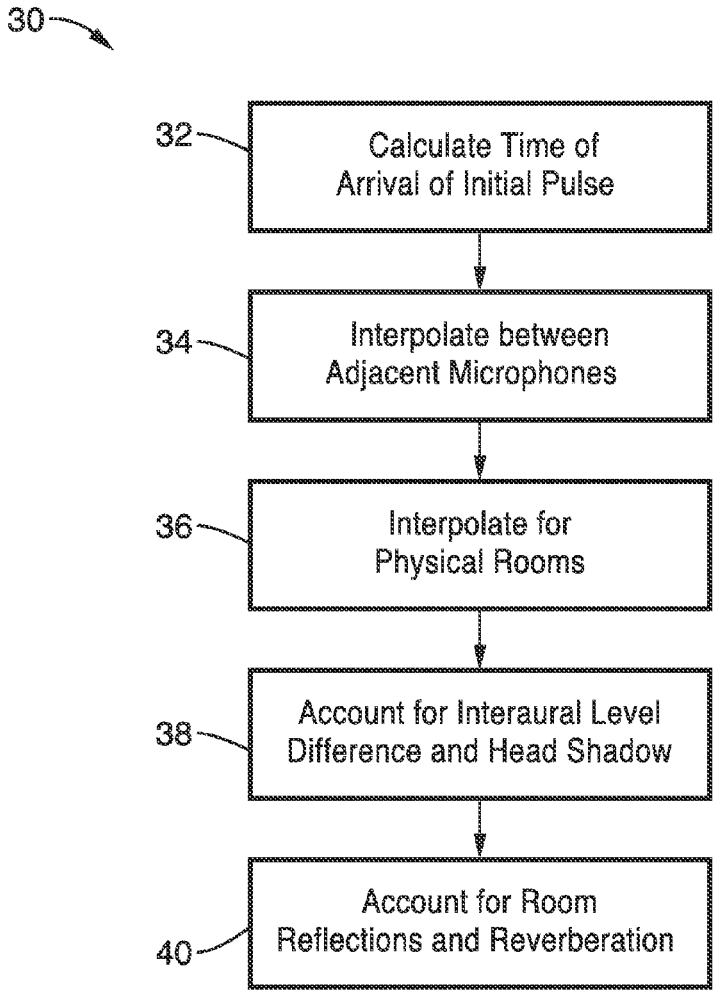
FIG. 3 is a block diagram which illustrates an exemplary method in accordance with the present invention for interpolating the signals between two adjacent microphones given the known location of the loudspeaker 14 relative to the MTB-style microphone array 16.

FIG. 3 illustrates an exemplary method 30 in accordance with the present invention for interpolating the signals between two adjacent microphones given the known location of the loudspeaker 14 relative to the MTB-style microphone array 16. First, the time of arrival of the initial pulse is calculated at step 32. Next at step 34, interpolation between adjacent microphones is performed. At step 36, interpolation for physical rooms is accounted for. At step 38, the method accounts for interaural level difference and head shadow. Finally, at step 40, room reflections and reverberation are accounted for. Each of these steps are discussed in further detail below.

Figure 5:
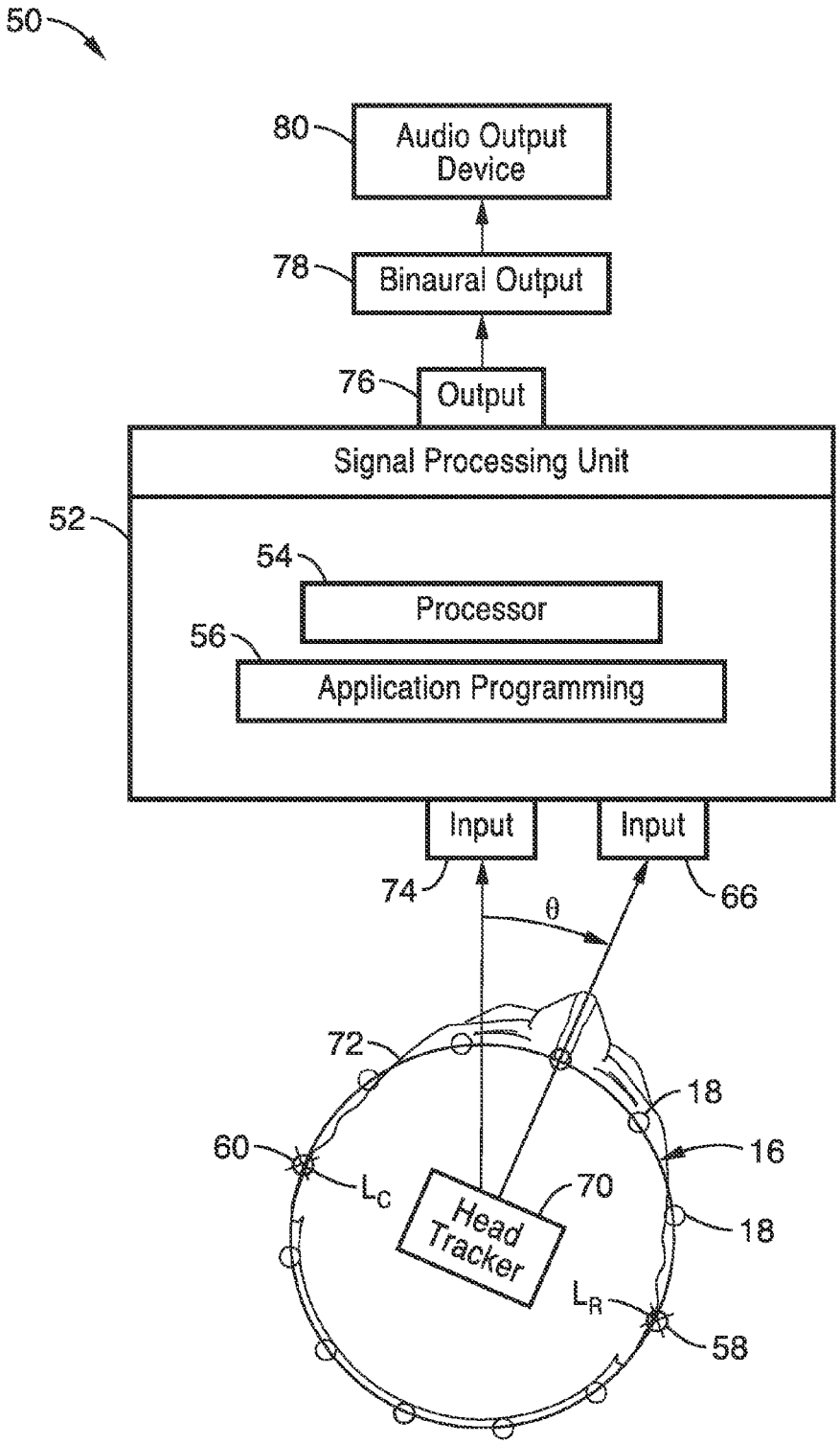
FIG. 5 illustrates an exemplary sound reproduction system according to the present invention.

FIG. 5 illustrates an exemplary sound reproduction system 50 for executing the methods disclosed herein. System 50 comprises a signal processing unit 52 having a processor 54 and application programming 56 executable on the processor for performing the methods of the present invention. The signal processing unit 52 includes an output 76 for connection to an audio output device 80. The signal processing unit 52 further includes an input 74 for connection to a head-tracking device 70; The signal processing unit 52 further comprises an input 66 configured to receive signals representative of the output of a plurality of microphones 18 (e.g. array 16) positioned to sample a sound field at points representing possible locations $L_C$ and $L_R$ of a listener's left and right ears with the listeners' head 72 were positioned in the sound field at the location of the microphones (e.g. microphones 58 and 60 coinciding with earl locations $L_C$ and $L_R$. The application programming 56 is configured to use the sound source locations input with respect to the array 16 and head tracker 70 to process the microphone array 16 output signals and present a binaural output 78 to the audio output device 80 in response to orientation of the listener's head 72 as indicated by the head tracking device 70. The signal processing unit 52 and programming 56 is configured to employ the full-bandwidth of the microphone output signals without filtering of the signals.

Figure 6:
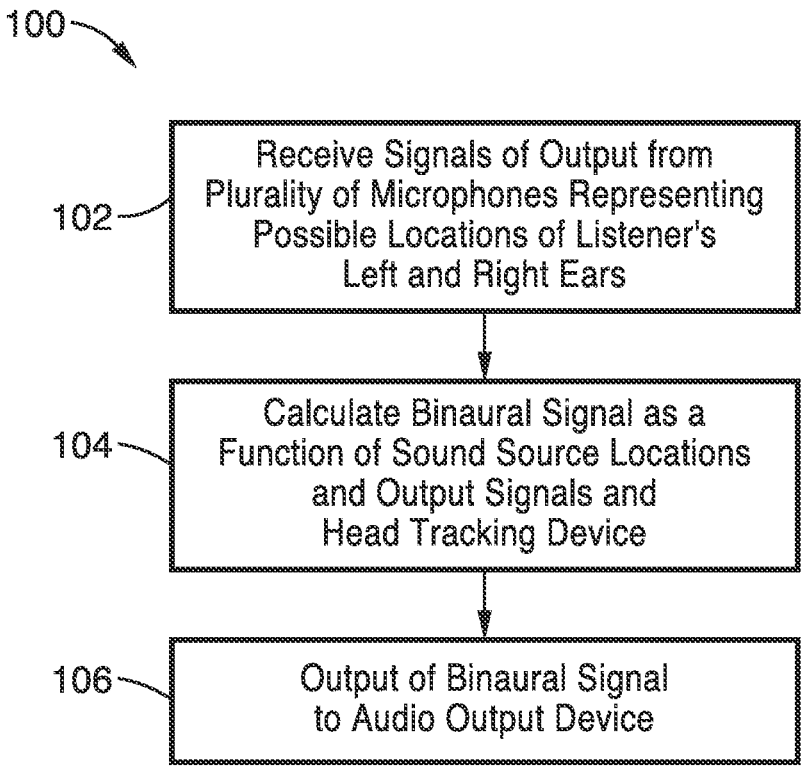
FIG. 6 shows a flow diagram of a sound reproduction method for use with application programming of FIG. 5 in accordance with the present invention.

FIG. 6 shows a flow diagram of sound reproduction method 100 for use with application programming 56 in accordance with the present invention. At step 102, signals representative of the output of a plurality of microphones 18 positioned to sample a sound field at points representing possible locations of a listener's left and right ears are received, wherein the locations correspond to locations of a listener's left and right ears of the listeners' head when positioned in said sound field at the location of the microphones 18.

At step 104, a binaural output is calculated using the sound source locations, microphone output signals and orientation of said listener's head as indicated by said head tracking device.

At step 106, the binaural signal is output to the audio output device.

A1. Time of Arrival Evaluation

Figure 4:
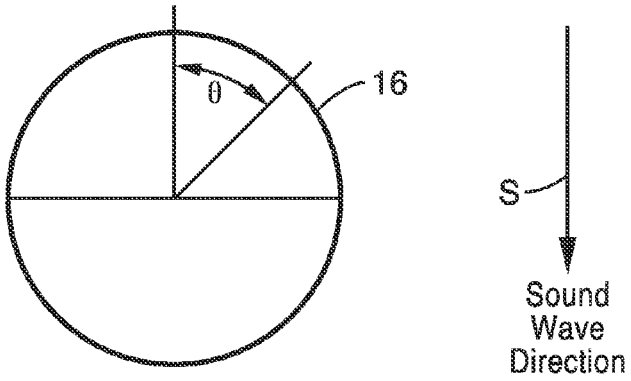
FIG. 4 is a schematic diagram showing the geometry used in determining the time of arrival of a sound wave incident on a sphere or cylinder.

For a spherical or cylindrical microphone array, calculation of the time of arrival of the initial pulse at step 32 (relative to the time at which it arrives at a point nearest the loudspeaker 14) can be well approximated using a simple geometric argument. FIG. 4 shows a schematic diagram of time of arrival for a spherical or cylindrical array 16. A circular cross-section and a sound wave at azimuth $\theta=0$ is assumed.

Denoting c to be the speed of sound and a the radius of the sphere or cylinder, for a microphone at azimuth $\theta$ and placed above the horizontal line, the travel time from the top of the circle to the microphone is:

$$\tau(\theta)=a/c(1-\cos|\theta|) \quad \text{Eq. 2}$$

Below the horizontal line, the wave travels along the circumference and the travel time is:

$$\tau(\theta)=a/c[1+(|\theta|-\pi/2)] \quad \text{Eq. 3}$$

The travel time is a nonlinear function of the azimuth for the proximal half circle defined by the azimuth of the sound source. It should be noted that for any azimuth, the ITD involves two polar opposite points, and:

$$ITD=a/c(|\theta|-\pi/2+\cos|\theta|) \quad \text{Eq. 4}$$

Eq. 4 for ITD is known as the Woodworth formula, and has been shown to provide a very good approximation to a measured ITD for the direct sound. It is appreciated that other ITD approximation methods may also be employed.

A2. Interpolation Between Adjacent Microphones.

Since, for the direct sound, the travel time from the sound source to adjacent microphones and to any intermediate position can be estimated by Eq. 2 and Eq. 3, time alignment of the signals of adjacent microphones before interpolation step 34 is performed to eliminate aliasing errors. The primary source of the aliasing problems that produce the flanging effects is the time displacement of components of the response. Time alignment of the signals of adjacent microphones before interpolation may thus be performed to eliminate aliasing errors. The evaluation $\tau(\theta)$ for the geometry of FIG. 4 is for a sound source at azimuth $\theta=0$. The results just have to be rotated to point to the direction of a sound source (loudspeaker) at any other azimuth. From this analysis, it is found that for any sound source 14, the direct sound signals captured by adjacent microphones 18 may be time aligned for any intermediate point.

A3. Interpolation for Physical Rooms.

In addressing step 36 for interpolating for physical rooms, we consider again the impulse response shown in FIG. 2. The direct sound and floor and ceiling responses dominate the response. Further, floor and ceiling reflections will arrive with a fixed delay with respect to the direct sound.

Several key observations can be made as follows:

(a) Since the direct sound, floor and ceiling reflections arrive from the same azimuth, the interaural time difference (ITD) for these three signals are the same;

(b) The energy of these three signals represents most of the total energy of the direct sound and all the early reflections; and (c) The multiple late reflections and the reverberation have no time coherence and little high frequency energy and will have little effect on the perceived ITD.

From these observations, it is found that the travel time computed on the basis of the time of arrival of the direct sound is a good approximation to the exact travel times and ITD for a physical room. Because this travel can be computed at an arbitrary number of angles around the cylinder 16 that approximates the head, one can perform a continuous angle evaluation of travel times. It is noted that this evaluation can be based as well on room models combined with Head Related Transfer Functions (HRTFs) or on measured room responses.

It is also appreciated that other methods to estimate the time of arrival, such as computing the cross-correlation of measured impulse responses as a function of azimuth, may be used.

A4. Interaural Level Difference and Head Shadow

Referring now to step 38, the method 30 provides a very good evaluation of the time of arrival from any sound source to any azimuth on the sphere or cylinder that supports the microphone array. The sphere or cylinder that supports the circular microphone array 16 also provides important cues to the perception of the location of sound sources and to the realism and quality of the motion tracked binaural listening experience. A second important auditory cue is the interaural level difference or ILD. An approximate ILD will be obtained if the microphone array 16 is mounted on a cylindrical structure that approximates the size of the human head, not only in its diameter but in its other dimensions as well. This physical structure will attenuate the high frequency sounds and signals at the microphones distal from a sound source, and thus approximate the head-shadow for any sound source orientation.

A5. Room Reflections and Reverberation.

Although the ITD and ILD are the primary cues for sound localization, the acoustics of the listening space, room reflections and reverberation calculated in step 40 are important to the quality and verisimilitude of the perceived sound. The room impulse responses from each loudspeaker 14 to the array 16 of microphones 18 provide a spatial sampling of the acoustics of the room. Thus, the method 30 allows the capture and subsequent use of the acoustics of any listening space or venue and their use in the rendering of motion tracked binaural sound. In particular, the reproduction of legacy music can make use of the acoustics most suitable to the type and character of the music.

B. Multiple Sound Sources and Common Legacy Loudspeakers Configurations

The application of the method 30 to any loudspeaker configuration such as stereo, 5.1 or 7.1 may be implemented via the interpolation of each of the loudspeaker impulse responses between adjacent microphones 18. The resulting sound signals are then summed to convey on headphones the sound of that legacy recording playing in the measured room with the ensemble of loudspeakers.

C. Implementation Alternatives

The methods above have been presented in terms of the room impulse responses from sound sources to each of the microphones of the array. These methods can be implemented in two ways:

1. Interpolation of time aligned impulse responses followed by the filtering using the composite room impulse response RIR.

2. Filtering of the signal at each microphone by the corresponding impulse response followed by interpolation of the time aligned resulting signals.

Computational and data handling considerations will dictate the preferable approach in each specific implementation.

D. Alternative Embodiments

The systems and methods illustrated in FIG. 1 through FIG. 6 may be embodied in diverse ways. The following exemplary embodiment was chosen for clarity of mathematical exposition, but other equivalent embodiments may be preferred for practical reasons.

Assuming an MTB-style array 16 configuration, a head tracker 70 is used to determine the location of the two points (e.g. 58, 60) on the sphere or cylinder corresponding to the locations ($L_R$ and $L_C$) of the listener's ears. A single sound source 14 of known location relative to the MTB-style microphone array is assumed (if there are multiple sound sources, the procedure is repeated for each source and the results are summed).

The ear nearest the sound source is called the ipsilateral ear, and the ear farthest from the sound source is called the contralateral ear. Each ear is bridged by two microphones, a nearest and a next-nearest microphone. The goal is to interpolate these signals without the need for band-limiting filters to determine the signal to be sent to the ear.

An ear is selected and defined according to the following quantities:

$s_n(t)$=signal from the microphone nearest to the ear location $s_{nn}(t)$=signal from the microphone next nearest to the ear location A head model (e.g. Eq. 2 and Eq. 3 of step 32) is used to compute the following quantities for the selected ear:

$\tau_n$=time of arrival for $s_n(t)$ $\tau_{nn}$=time of arrival for $s_{nn}(t)$ $\tau$=time of arrival at the ear location.

ITD=magnitude of the difference of the arrival times for the two ear locations:

$$w_n=|(\tau-\tau_{nn})/(\tau_n-\tau_{nn})|$$

$$w_{nn}=1-w_n$$

Next, the interpolated signal $s_{int}(t)$ is obtained by merely weighting and summing the delayed signals:

$$s_{int}(t)=w_n s_n(t-\tau_{nn})+w_{nn} s_{nn}(t-\tau_n).$$

It should be noted that the above exemplar method employs wideband interpolation. No band-limiting filtering of the signals prior to interpolation is required.

With this embodiment, the interpolated signal arrives at time $\tau_{int}=\tau_n+\tau_{nn}$. If we could advance the signal in time, we would advance it by $\tau_{int}-\tau$. Because we cannot advance a signal, additional delays are introduced such that the correct value is obtained for ITD, the interaural time difference.

First, the procedure described above is repeated for the other ear. The time difference $\Delta\tau$ between the $\tau_{int}$ values for the two ears is then computed. Then, if $\Delta\tau$<ITD, the contralateral ear signal is delayed by ITD−$\Delta\tau$, and if $\Delta\tau$>ITD, the ipsilateral ear signal is delayed by $\Delta\tau$−ITD.

It is appreciated that other embodiments that require less total delay are possible. In addition, for legacy recordings, it is possible to obtain equivalent results by interpolating the impulse responses rather than interpolating the microphone signals, and obtaining the signals to be sent to the ears by filtering the signals intended for the loudspeakers by the interpolated impulse responses. Finally, digital implementations may require working on segments of the signal that are stored in buffer arrays, and dynamically changing the weightings according to the listener's head position. Other variations are also contemplated.

Embodiments of the present invention may be described with reference to flowchart illustrations of methods and systems according to embodiments of the invention, and/or algorithms, formulae, or other computational depictions, which may also be implemented as computer program products. In this regard, each block or step of a flowchart, and combinations of blocks (and/or steps) in a flowchart, algorithm, formula, or computational depiction can be implemented by various means, such as hardware, firmware, and/or software including one or more computer program instructions embodied in computer-readable program code logic. As will be appreciated, any such computer program instructions may be loaded onto a computer, including without limitation a general purpose computer or special purpose computer, or other programmable processing apparatus to produce a machine, such that the computer program instructions which execute on the computer or other programmable processing apparatus create means for implementing the functions specified in the block(s) of the flowchart(s).

Accordingly, blocks of the flowcharts, algorithms, formulae, or computational depictions support combinations of means for performing the specified functions, combinations of steps for performing the specified functions, and computer program instructions, such as embodied in computer-readable program code logic means, for performing the specified functions. It will also be understood that each block of the flowchart illustrations, algorithms, formulae, or computational depictions and combinations thereof described herein, can be implemented by special purpose hardware-based computer systems which perform the specified functions or steps, or combinations of special purpose hardware and computer-readable program code logic means.

Furthermore, these computer program instructions, such as embodied in computer-readable program code logic, may also be stored in a computer-readable memory that can direct a computer or other programmable processing apparatus to function in a particular manner, such that the instructions stored in the computer-readable memory produce an article of manufacture including instruction means which implement the function specified in the block(s) of the flowchart(s). The computer program instructions may also be loaded onto a computer or other programmable processing apparatus to cause a series of operational steps to be performed on the computer or other programmable processing apparatus to produce a computer-implemented process such that the instructions which execute on the computer or other programmable processing apparatus provide steps for implementing the functions specified in the block(s) of the flowchart(s), algorithm(s), formula(e), or computational depiction(s).

From the discussion above it will be appreciated that the invention can be embodied in various ways, including the following:

1. A sound reproduction apparatus, comprising: (a) a processor; (b) programming executable on the processor for: (i) receiving signals representative of the output of a plurality of microphones, said microphones positioned to sample a sound field at points representing possible locations of a listener's left and right ears when positioned in said sound field at the location of the microphones; (ii) receiving a location of at least one sound source relative to said plurality of microphones; (iii) receiving orientation data of the listener's head; and (iv) calculating a binaural output using the sound source location, microphone output signals and orientation data; (v) wherein the binaural output comprises the full-bandwidth of the microphone output signals.

2. The apparatus of any previous embodiment, said programming further configured for: interpolating the signal between adjacent headphones corresponding to a location of the listener's left or right ear; wherein the signal is interpolated without band-limiting filters.

3. The apparatus of any previous embodiment, said programming further configured for: introducing one or more time delays corresponding to the interpolated signal.

4. The apparatus of any previous embodiment, wherein the interpolated signal is obtained by weighting and summing a plurality of delayed signals.

5. The apparatus of any previous embodiment, said programming further configured for: introducing an additional delay to account for interaural time difference.

6. The apparatus of any previous embodiment, wherein interpolating the signal between adjacent headphones comprises combining signals representative of a first output from a nearest microphone and a second output from a next nearest microphone in relation to one of the locations of a listener's left and right ears.

7. The apparatus of any previous embodiment, wherein interpolating the signal between adjacent headphones comprises: performing time alignment of the signals of adjacent microphones.

8. The apparatus of any previous embodiment, said programming further configured for: accounting for floor and ceiling reflections in the calculated binaural output.

9. The apparatus of any previous embodiment, said programming further configured for: accounting for interaural level difference and head shadow in the calculated binaural output.

10. The apparatus of any previous embodiment, said programming further configured for: accounting for room reflections and reverberation in the calculated binaural output.

11. The apparatus of any previous embodiment, said programming further configured for: calculating a second binaural output corresponding to a second sound source by using the second sound source location, microphone output signals and orientation data; wherein the second binaural output comprises the full-bandwidth of the microphone output signals; and summing the binaural output and the second binaural output corresponding to an ensemble of sound sources.

12. A sound reproduction apparatus, comprising: (a) a signal processing unit comprising: (i) an output for connection to an audio output device; (ii) an input for connection to a head-tracking device; (iii) an input for connection to a plurality of microphones; (iv) a processor; and (b) programming executable on the processor and configured for: (i) receiving signals representative of the output of a plurality of microphones, said microphones positioned to sample a sound field at points representing possible locations of a listener's left and right ears when positioned in said sound field at the location of the microphones; (ii) receiving a location of at least one sound source relative to said plurality of microphones; (iii) receiving orientation data of the listener's head; and (iv) calculating a binaural output using the sound source location, microphone output signals and orientation data; (v) wherein the binaural output comprises the full-bandwidth of the microphone output signals.

13. The apparatus of any previous embodiment, said programming further configured for: interpolating the signal between adjacent headphones corresponding to a location of the listener's left or right ear; wherein the signal is interpolated without band-limiting filters.

14. The apparatus of any previous embodiment, said programming further configured for: introducing one or more time delays corresponding to the interpolated signal.

15. The apparatus of any previous embodiment, wherein the interpolated signal is obtained by weighting and summing a plurality of delayed signals.

16. An apparatus in any of the previous embodiments, said programming further configured for: introducing an additional delay to account for interaural time difference.

17. The apparatus of any previous embodiment, wherein interpolating the signal between adjacent headphones comprises combining signals representative of a first output from a nearest microphone and a second output from a next nearest microphone in relation to one of the locations of a listener's left and right ears.

18. The apparatus of any previous embodiment, wherein interpolating the signal between adjacent headphones comprises: performing time alignment of the signals of adjacent microphones.

19. The apparatus of any previous embodiment, said programming further configured for: accounting for floor and ceiling reflections in the calculated binaural output.

20. The apparatus of any previous embodiment, said programming further configured for: accounting for interaural level difference and head shadow in the calculated binaural output.

21. The apparatus of any previous embodiment, said programming further configured for: accounting for room reflections and reverberation in the calculated binaural output.

22. The apparatus of any previous embodiment, said programming further configured for: calculating a second binaural output corresponding to a second sound source by using the second sound source location, microphone output signals and orientation data; wherein the second binaural output comprises the full-bandwidth of the microphone output signals; and summing the binaural output and the second binaural output corresponding to an ensemble of sound sources.

23. A method for processing an audio signal using a signal processing unit, the method comprising: receiving signals representative of the output of a plurality of microphones, said microphones positioned to sample a sound field at points representing possible locations of a listener's left and right ears when positioned in said sound field at the location of the microphones; receiving a location of at least one sound source relative to said plurality of microphones; receiving orientation data of the listener's head; and calculating a binaural output using the sound source location, microphone output signals and orientation data; wherein the binaural output comprises the full-bandwidth of the microphone output signals.

24. The method of any previous embodiment, further comprising: interpolating the signal between adjacent headphones corresponding to a location of the listener's left or right ear; wherein the signal is interpolated without band-limiting filters.

25. The method of any previous embodiment, further comprising: introducing one or more time delays corresponding to the interpolated signal.

26. The method of any previous embodiment, wherein the interpolated signal is obtained by weighting and summing a plurality of delayed signals.

27. The method of any previous embodiment, further comprising: introducing an additional delay to account for interaural time difference.

28. The method of any previous embodiment, wherein interpolating the signal between adjacent headphones comprises combining signals representative of a first output from a nearest microphone and a second output from a next nearest microphone in relation to one of the locations of a listener's left and right ears.

29. The method of any previous embodiment, wherein interpolating the signal between adjacent headphones comprises performing time alignment of the signals of adjacent microphones.

30. The method of any previous embodiment, further comprising: calculating a second binaural output corresponding to a second sound source by using the second sound source location, microphone output signals and orientation data; wherein the second binaural output comprises the full-bandwidth of the microphone output signals; and summing the binaural output and the second binaural output corresponding to an ensemble of sound sources.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A sound reproduction apparatus, comprising:

(a) a processor; and (b) programming executable on the processor and configured for:

(i) receiving signals representative of the output of a plurality of microphones, said microphones positioned to sample a sound field at points representing possible locations of a listener's left and right ears when positioned in said sound field at the location of the microphones;

(ii) receiving a location of at least one sound source relative to said plurality of microphones;

(iii) receiving orientation data of the listener's head;

(iv) calculating a binaural output using the sound source location, microphone output signals and orientation data; and (v) interpolating the signal between adjacent headphones corresponding to a location of the listener's left or right ear, wherein the signal is interpolated without band-limiting filters; and (vi) wherein the binaural output comprises the full-bandwidth of the microphone output signals.

2. An apparatus as recited in claim 1, wherein said programming is further configured for introducing one or more time delays corresponding to the interpolated signal.

3. An apparatus as recited in claim 2, wherein the interpolated signal is obtained by weighting and summing a plurality of delayed signals.

4. An apparatus as recited in claim 2, wherein said programming is further configured for introducing an additional delay to account for interaural time difference.

5. An apparatus as recited in claim 1, wherein interpolating the signal between adjacent headphones comprises combining signals representative of a first output from a nearest microphone and a second output from a next nearest microphone in relation to one of the locations of a listener's left and right ears.

6. An apparatus as recited in claim 1, wherein interpolating the signal between adjacent headphones comprises performing time alignment of the signals of adjacent microphones.

7. An apparatus as recited in claim 1, wherein said programming is further configured for accounting for floor and ceiling reflections in the calculated binaural output.

8. An apparatus as recited in claim 1, wherein said programming is further configured for accounting for interaural level difference and head shadow in the calculated binaural output.

9. An apparatus as recited in claim 1, wherein said programming is further configured for accounting for room reflections and reverberation in the calculated binaural output.

10. An apparatus as recited in claim 1, wherein said programming is further configured for:

calculating a second binaural output corresponding to a second sound source by using the second sound source location, microphone output signals and orientation data;

wherein the second binaural output comprises the full-bandwidth of the microphone output signals; and summing the binaural output and the second binaural output corresponding to an ensemble of sound sources.

11. A sound reproduction apparatus, comprising:

(a) a signal processing unit comprising:

(i) an output for connection to an audio output device;

(ii) an input for connection to a head-tracking device;

(iii) an input for connection to a plurality of microphones;

(iv) a processor; and (b) programming executable on the processor and configured for:

(i) receiving signals representative of the output of a plurality of microphones, said microphones positioned to sample a sound field at points representing possible locations of a listener's left and right ears when positioned in said sound field at the location of the microphones;

(ii) receiving a location of at least one sound source relative to said plurality of microphones;

(iii) receiving orientation data of the listener's head; and (iv) calculating a binaural output using the sound source location, microphone output signals and orientation data; and (v) interpolating the signal between adjacent headphones corresponding to a location of the listener's left or right ear, wherein the signal is interpolated without band-limiting filters; and (vi) wherein the binaural output comprises the full-bandwidth of the microphone output signals.

12. An apparatus as recited in claim 11, wherein said programming is further configured for introducing one or more time delays corresponding to the interpolated signal.

13. An apparatus as recited in claim 12, wherein the interpolated signal is obtained by weighting and summing a plurality of delayed signals.

14. An apparatus as recited in claim 12, wherein said programming is further configured for introducing an additional delay to account for interaural time difference.

15. An apparatus as recited in claim 11, wherein interpolating the signal between adjacent headphones comprises combining signals representative of a first output from a nearest microphone and a second output from a next nearest microphone in relation to one of the locations of a listener's left and right ears.

16. An apparatus as recited in claim 11, wherein interpolating the signal between adjacent headphones comprises performing time alignment of the signals of adjacent microphones.

17. An apparatus as recited in claim 11, wherein said programming is further configured for accounting for floor and ceiling reflections in the calculated binaural output.

18. An apparatus as recited in claim 11, wherein said programming is further configured for accounting for interaural level difference and head shadow in the calculated binaural output.

19. An apparatus as recited in claim 11, wherein said programming is further configured for accounting for room reflections and reverberation in the calculated binaural output.

20. An apparatus as recited in claim 11, wherein said programming is further configured for:

calculating a second binaural output corresponding to a second sound source by using the second sound source location, microphone output signals and orientation data;

wherein the second binaural output comprises the full-bandwidth of the microphone output signals; and summing the binaural output and the second binaural output corresponding to an ensemble of sound sources.

21. A method for processing an audio signal using a signal processing unit, the method comprising:

receiving signals representative of the output of a plurality of microphones, said microphones positioned to sample a sound field at points representing possible locations of a listener's left and right ears when positioned in said sound field at the location of the microphones;

receiving a location of at least one sound source relative to said plurality of microphones;

receiving orientation data of the listener's head; and calculating a binaural output using the sound source location, microphone output signals and orientation data; and interpolating the signal between adjacent headphones corresponding to a location of the listener's left or right ear, wherein the signal is interpolated without band-limiting filters; and wherein the binaural output comprises the full-bandwidth of the microphone output signals.

22. A method as recited in claim 21, further comprising introducing one or more time delays corresponding to the interpolated signal.

23. A method as recited in claim 22, wherein the interpolated signal is obtained by weighting and summing a plurality of delayed signals.

24. A method as recited in claim 22, further comprising introducing an additional delay to account for interaural time difference.

25. A method as recited in claim 21, wherein interpolating the signal between adjacent headphones comprises combining signals representative of a first output from a nearest microphone and a second output from a next nearest microphone in relation to one of the locations of a listener's left and right ears.

26. A method as recited in claim 21, wherein interpolating the signal between adjacent headphones comprises performing time alignment of the signals of adjacent microphones.

27. A method as recited in claim 21, further comprising:

calculating a second binaural output corresponding to a second sound source by using the second sound source location, microphone output signals and orientation data;

wherein the second binaural output comprises the full-bandwidth of the microphone output signals; and summing the binaural output and the second binaural output corresponding to an ensemble of sound sources.

* * * * *